US005823323A

United States Patent [19]

Seymour et al.

[11] Patent Number: 5,823,323

[45] Date of Patent: Oct. 20, 1998

[54] CIRCUIT BREAKER CONTACT POSITION INDICATING UNIT

[75] Inventors: Raymond K. Seymour, Plainville; Michael C. Guerrette, Bristol; James L. Rosen, West Hartford, all of Conn.

[73] Assignee: General Electric Company, New York, N.Y.

[21] Appl. No.: 794,108

[22] Filed: Feb. 3, 1997

[51] Int. Cl.[6] ..... H01H 9/00; H01H 67/02

[52] U.S. Cl. ..... 200/308; 335/202

[58] Field of Search ..... 200/17 R, 573, 200/574, 308; 218/1; 335/6, 14, 16, 20, 26, 132, 202, 177, 178, 179

[56] References Cited

U.S. PATENT DOCUMENTS

| | | | |
|---|---|---|---|
| 3,783,215 | 1/1974 | Brumfield | 200/308 |
| 4,408,174 | 10/1983 | Doughty et al. . | |
| 4,658,323 | 4/1987 | Dougherty . | |
| 4,794,356 | 12/1988 | Yu et al. | 335/14 |
| 4,831,221 | 5/1989 | Yu et al. | 335/202 |
| 5,140,115 | 8/1992 | Morris | 200/308 |
| 5,485,134 | 1/1996 | Bogue et al. . | |
| 5,502,286 | 3/1996 | Pollman et al. . | |
| 5,534,833 | 7/1996 | Castonguay et al. | 335/14 |
| 5,605,224 | 2/1997 | Seymour et al. . | |
| 5,646,586 | 7/1997 | Castonguay et al. | 335/132 |

*Primary Examiner*—Khanh Dang

*Attorney, Agent, or Firm*—Richard A. Menelly; Carl B. Horton

[57] ABSTRACT

A circuit breaker contact position indicator is mounted on the same support platform as the circuit breaker electronic trip unit and contains a micro-switch to provide indication to the trip unit of the status of the circuit breaker contacts. The switch interacts with the circuit breaker operating mechanism crossbar cam by means of a spring-loaded paddle attached to the trip unit support platform.

13 Claims, 4 Drawing Sheets

CIRCUIT BREAKER CONTACT POSITION INDICATING UNIT

BACKGROUND OF THE INVENTION

U.S. Pat. No. 4,408,174 entitled "Accessory Mounting Module for J and K Frame Breakers" discloses a mounting arrangement for receiving an auxiliary switch accessory to indicate the occurrence of an overcurrent circuit interruption within a protected electric distribution circuit U.S. Pat. No. 5,605,224 issuing on 25 Feb. 1997 (application Ser. No. 08/247,900) entitled "Accessory Compartment for High Ampere Rated Circuit Breaker" describes an integrated circuit breaker having several accessory functions along with automatic overcurrent protection.

U.S. Pat. No. 5,485,134 entitled "Auxiliary Switch Accessory Module Unit for High Ampere-Rated Circuit Breaker" describes an auxiliary switch module that positionally mounts a plurality of auxiliary switches in interface relation with the circuit breaker operating mechanism to input the ON-OFF conditions of the circuit breaker contacts to the circuit breaker electronic trip unit.

A good description of a combined trip unit and accessory support housing for circuit breaker field-installable accessories and electronic trip units is found within aforementioned U.S. Pat. No. 5,605,224.

Variations in the size and space arrangements of the circuit breaker operating mechanism components often requires manual adjustment of the auxiliary switch mounting platforms to insure that the auxiliary switch components do not become damaged over long periods of operation.

One purpose of the invention, accordingly, is to provide a mounting arrangement between the auxiliary switch and the circuit breaker operating mechanism crossbar to prevent damage to the auxiliary switch components without requiring additional adjustment to the switch mounting platform.

SUMMARY OF THE INVENTION

The circuit breaker electronic trip unit controlling a high ampere-rated circuit breaker is contained within a recess in the circuit breaker cover. A circuit breaker contact position indicator is mounted on the same support platform as the trip unit and contains a micro-switch to provide indication to the trip unit of tie status of the circuit breaker contacts. The switch interacts with the circuit breaker operating mechanism crossbar cam by means of a spring-loaded paddle attached to the trip unit support platform.

DESCRIPTION OF THE PREFERRED EMBODIMENT

Figure 1:
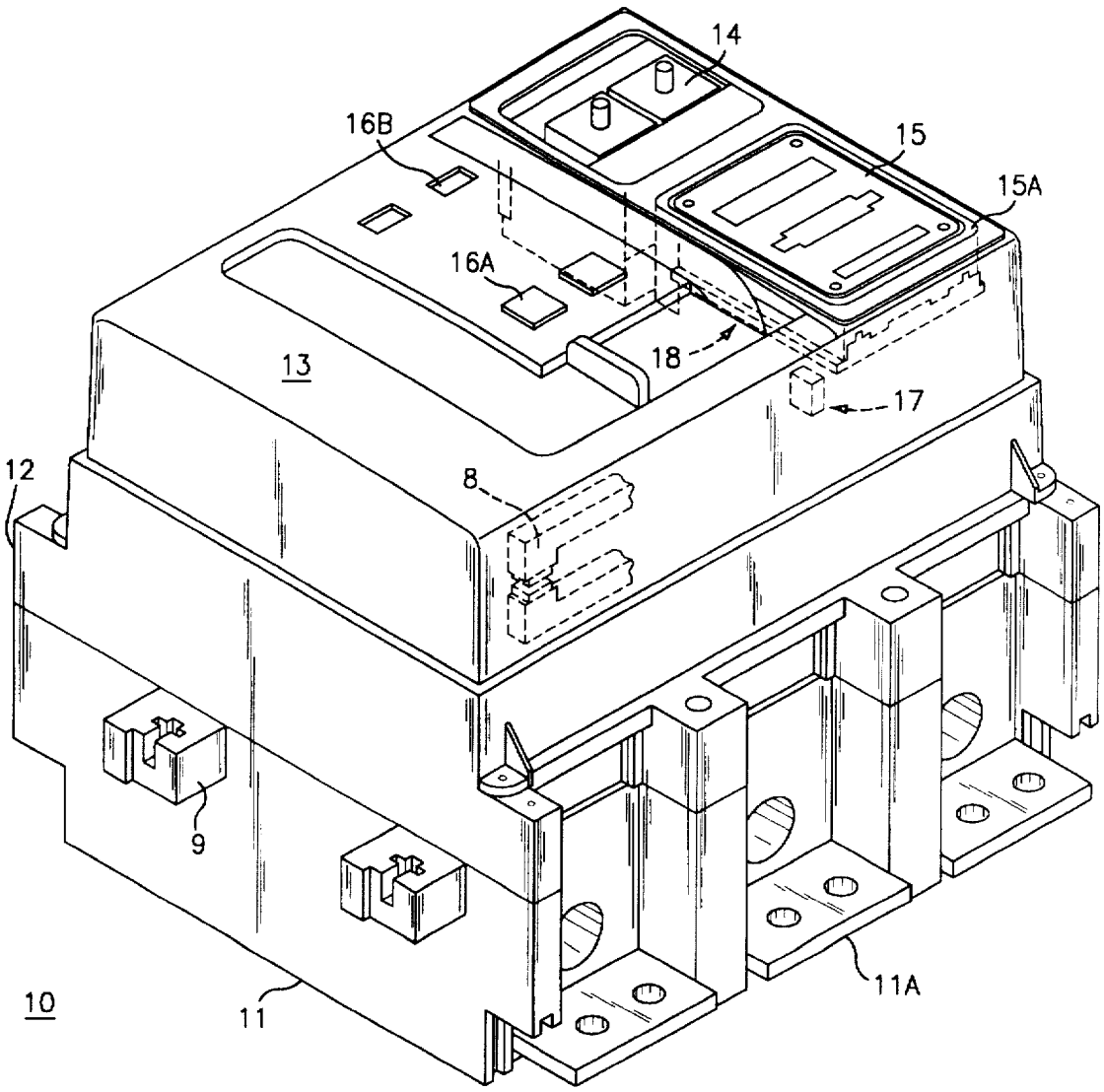
FIG. 1 is a top perspective view of a high ampere-rated circuit breaker containing the auxiliary switch accessory module according to the invention.

The high ampere-rated circuit breaker 10 shown in FIG. 1 is capable of transferring several thousand amperes quiescent circuit current at several hundred volts potential without overheating. The circuit breaker consists of an electrically -insulated base 11 to which an intermediate cover 12 of similar insulative material is attached prior to attaching the top cover 13, also consisting of an electrically-insulative material. Electrical connection with the interior current-carrying contacts 8 is made by load terminal straps 11A extending from one side of the base and line terminal straps(not shown) extending from the opposite side thereof. The interior component are controlled by an electronic trip unit 15 that is contained within the trip unit recess 15A next to the trip unit accessories 14 contained within the accessory's recess 14A both formed in the top surface of the top cover 13. The trip unit is similar to that described within U.S. Pat. No. 4,658,323 entitled "RMS Calculation Circuit for Digital Circuit Interrupters" and interacts with the accessories 14, such as the bell alarm and Lock-Out Accessory described within U.S. Pat. No. 5,502,286 entitled "Bell Alarm and Lock-Out for High Ampere-Rated Circuit Breakers". The buttons 16A allow the circuit breaker operating mechanism to be reset after a circuit interruption has occurred, and indicators 16B provide visual indication as to the ON and-Off conditions of the circuit breaker contacts. As described within the aforementioned U.S. Pat. No. 5,605,244, a common support frame 18 supports both the accessories 14 as well as the trip unit 15. The same support frame further serves to support the contact position indicator unit 17 which functions to provide indication of the condition of the circuit breaker contacts to the trip unit.

Figure 2:
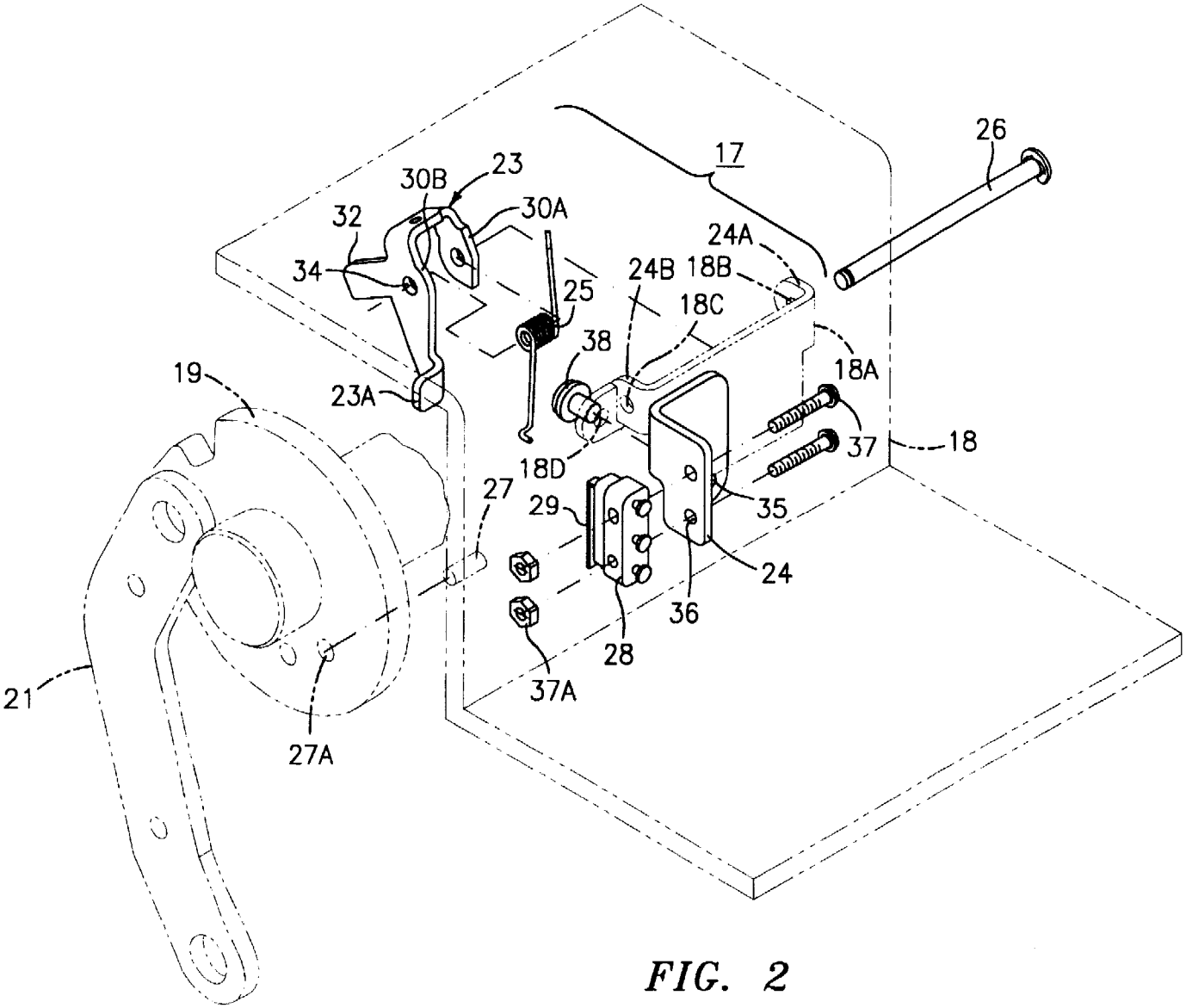
FIG. 2 is a top perspective view of the components within the accessory module of FIG. 1 prior to assembly.

The assembly between the contact position indicator unit 17, the accessory and trip unit support 18 and the operating mechanism crankshaft cam 26 is shown in FIG. 2 with the accessory and trip unit support, the operating mechanism crankshaft cam, and the main contact linkage 21 depicted in phantom. The snapswitch or microswitch 28 is attached to the contact position indicator unit support platform 24 by means of bolts 37, nuts 37A and apertures 36. A pair of sidearms 24A, 24B upstanding from the trip unit and accessory support frame 18 include corresponding apertures 18B, 18C. The U-shaped lever 23 includes a pair of sidearms 30A, 30B which include corresponding apertures, one of which is shown at 34. The extended pivot pin 26 extends through these apertures and through the apertures 18B, 18C formed in the tab 18A on the trip unit and accessory support frame 18 and captures the return spring 25 between the U-shaped lever sidearms. With the support platform 24 attached to the trip unit and accessory support frame 18, by means of the screw 38, aperture 18D and threaded opening 35, the tab 23A offset from the end of the U-shaped lever 23, is positioned against the microswitch actuator lever 29 provided the position pin 27 within the aperture 27A on the operating mechanism crankshaft cam 19 is out of abutment with the leg 32 extending from the rear of the U-shaped lever. In this position, the circuit breaker contacts 8, shown in FIG. 1 are in the open position. Both normally open and normally closed contacts can be employed. In this case, reverse logic is used to faiclitate the trip unit signal processing.

Figure 3:
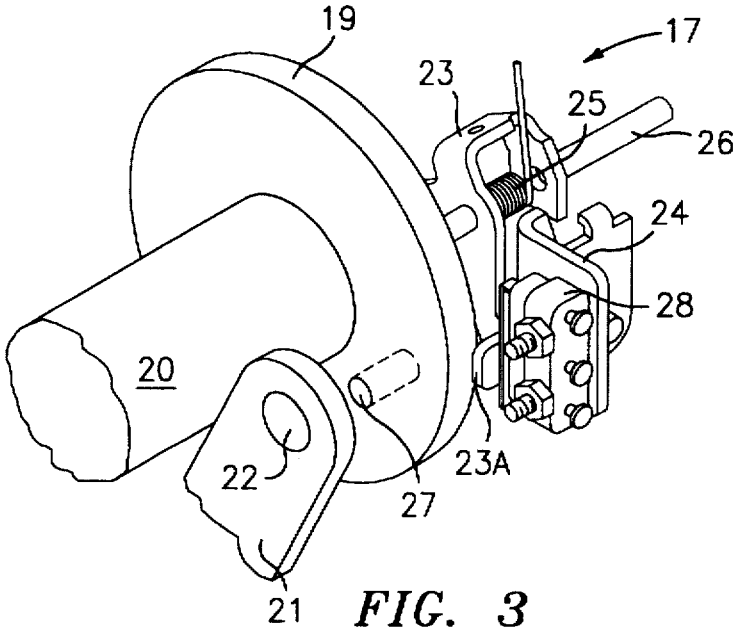
FIG. 3 is a top perspective view of the accessory module of FIG. 1 positioned relative to the circuit breaker cross bar.

The association between the contact position indicator unit 17 and the cam plate 19 connecting with the circuit breaker operating mechanism shaft 20 is best seen by referring now to FIG. 3. The circuit breaker main contact linkage 21 that controls the condition of the circuit breaker contacts connects with the cam 19 by means of the pivot pin 22. A position post 27 is connected with the cam to provide mechanical logic relative to the microswitch 28 that is attached to the trip unit accessory support 18 (FIG. 4) by means of a support platform 24. The U-shaped lever 23 is arranged on the platform by means of the extended pivot pin 26, which pivot pin terminates within an aperture(not shown) formed at an opposite end of the trip unit support. The tab 23A extending from the U-shaped lever 23 interacts with the position post 27 to control the electrical output from the microswitch 28 in the manner shown in FIG. 4.

Figure 4:
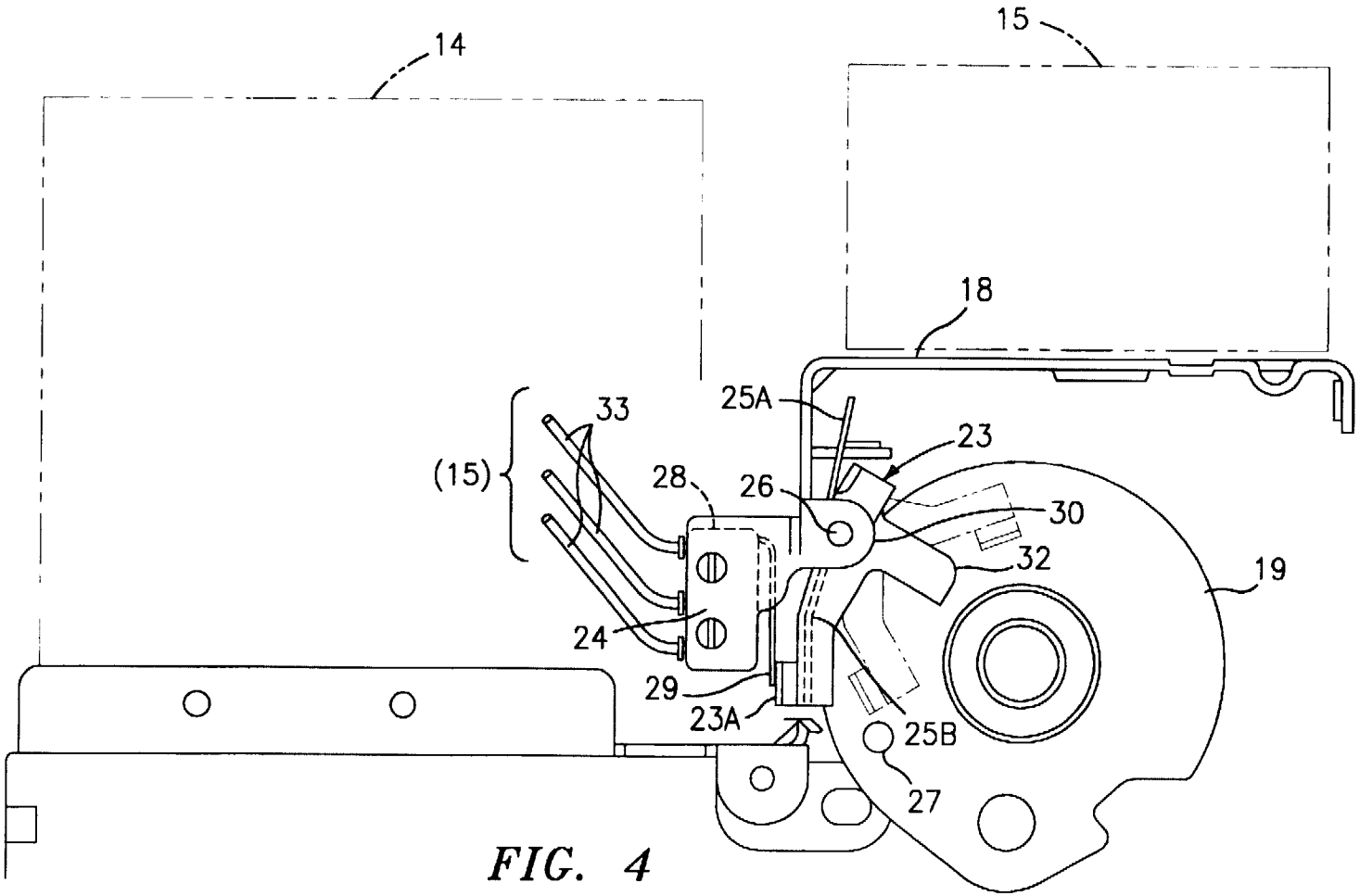
FIG. 4 is a side view of a part of the circuit breaker of FIG. 1 depicting the attachment of the auxiliary switch assembly to the circuit breaker support platform.

In FIG. 4, an accessory 14 along with the electronic trip unit 15 are depicted in phantom relative to the trip un it and accessory support 18 to indicate the positional relationship between the support platform 24, which is attached to the accessory support by means of a screw (not shown). The ON/OFF indication of the circuit breaker contacts is relayed to the electronic trip unit 15 by means of the conductors 33 in the following manner. With the position post 27, on the cam 19, out of contact with the arm 32 extending from the U-shaped lever 23, the tab 23A, abuts against the actuator lever 29 on the microswitch 28 which indicates a contacts open condition over conductors 33 to the trip unit 15. When the contacts close, by rotation of the cam 19, the post 27 strikes against the arm 32 to rotate the U-shaped lever 23 counter-clockwise moving the tab 23A away from the switch actuator lever 29, as indicated in phantom, and relay this contacts closed condition over conductors 33 to the trip unit 15. The pivotal arrangement of the U-shaped lever 23 by means of the pivot pin 26 within the sidearm 30 that extends upright from the support platform is controlled by means of the return spring 25, shown earlier in FIG. 3, which is biased against the accessory support 18 at one end by means of a first leg 25A and against the tab 23A at an opposite end by means of a second leg 25B. The provision of the return spring is an important feature of the invention since it allows flexible contact between the collective components without damage, takes up tolerance variations between the components and returns the tab 23A to the position shown in solid lines after the position pin 27 is away from the arm 32.

A circuit breaker contact arm position indicator switch has herein been described for transferring circuit breaker contact position to an electronic trip unit. Means are provided for automatic tolerance adjustment between the circuit breaker operating mechanism and the indicator switch components.

We claim:

1. An industrial-rated circuit breaker for high level overcurrent protection comprising:

an insulative base;

an insulative circuit breaker cover arranged on said insulative base;

a pair of movable contacts on said insulative base;

an electronic trip unit within said cover and arranged for determining overcurrent conditions within a protected circuit;

an operating mechanism drive shaft within said base arranged for moving said pair of circuit breaker contacts between ON and OFF positions upon occurrence of said overcurrent conditions on receipt of a control signal from said trip unit; and a contact position switch assembly within said base arranged for providing indication to said electronic trip unit of said ON and OFF positions of said circuit breaker contacts.

2. The circuit breaker of claim 1 wherein said contact position switch assembly comprises a rotatable lever and a support platform.

3. The circuit breaker of claim 2 including a trip unit support member wherein said contact position switch assembly includes means for attachment to said trip unit support member.

4. The circuit breaker of claim 2 further including a microswitch arranged on said support platform.

5. The circuit breaker of claim 4 wherein said rotatable lever includes a tab at one end and said microswitch includes a microswitch actuator lever, said tab being arranged for contacting microswitch actuator lever.

6. The circuit breaker of claim 4 wherein said rotatable lever further includes an extension arm, a position pin and a cam, said extension arm being arranged for contacting said position pin extending from said cam attached to said operating mechanism drive shaft.

7. The circuit breaker of claim 4 further including a pivot pin, whereby said rotatable lever is pivotally attached to said trip unit support member by means of said pivot pin.

8. The circuit breaker of claim 7 including a return spring arranged on said pivot pin, one end of said return spring biased against a part of said support member and an opposite end of said returns spring biased against said tab.

9. The circuit breaker of claim 5 wherein said tab abuts said in microswitch actuator lever when said contacts are in an OFF position and said actuator lever is away from said microswitch actuator lever when said contacts are in an ON position.

10. A contact position switch assembly comprising:

a support platform;

a rotatable lever arranged on said support platform, said rotatable lever having a tab at one end;

a microswitch arranged on said support platform proximate said rotatable lever;

a circuit breaker trip unit support member;

means for attaching said support platform to said circuit breaker trip unit support member; and a microswitch actuator lever on said support platform interfacing with said microswitch for transmitting ON and OFF states of said microswitch.

11. The contact position switch assembly of claim 10 wherein said rotatable lever further includes an extension arm arranged for contacting a position pin extending from a cam attached to a circuit breaker operating mechanism drive shaft.

12. The contact position switch assembly of claim 11 wherein said rotatable lever is pivotally attached to said trip unit support member by means of a pivot pin.

13. The contact position switch assembly of claim 12 including a return spring arranged on said pivot pin, one end of said return spring biased against a part of said support member and an opposite end of said returns spring biased against said tab.

* * * * *